US007775941B2

(12) United States Patent
Nguyen et al.

(10) Patent No.: US 7,775,941 B2
(45) Date of Patent: Aug. 17, 2010

(54) EXERCISE APPARATUS FOR TRANSPORT VEHICLES AND RELATED METHODS

(75) Inventors: Tony H. Nguyen, Renton, WA (US); Michael A. Long, Freeland, WA (US)

(73) Assignee: The Boeing Company, Chicago, IL (US)

( * ) Notice: Subject to any disclaimer, the term of this patent is extended or adjusted under 35 U.S.C. 154(b) by 245 days.

(21) Appl. No.: 11/842,835

(22) Filed: Aug. 21, 2007

(65) Prior Publication Data

US 2007/0293375 A1 Dec. 20, 2007

Related U.S. Application Data

(63) Continuation-in-part of application No. 11/006,424, filed on Dec. 7, 2004, now abandoned.

(51) Int. Cl.
*A63B 22/04* (2006.01)
*A63B 21/05* (2006.01)

(52) U.S. Cl. ..... 482/52; 482/60; 482/128

(58) Field of Classification Search ..... 482/51, 482/57–65, 148, 904, 908, 128
See application file for complete search history.

(56) References Cited

U.S. PATENT DOCUMENTS

| | | | | |
|---|---|---|---|---|
| 3,638,941 | A | 2/1972 | Kulkens | |
| 3,738,649 | A * | 6/1973 | Miller | 482/57 |
| 4,013,287 | A | 3/1977 | Dickman | |
| 4,805,901 | A * | 2/1989 | Kulick | 482/63 |
| 4,838,547 | A * | 6/1989 | Sterling | 482/128 |
| 4,921,247 | A * | 5/1990 | Sterling | 482/138 |
| 5,044,633 | A | 9/1991 | Rice | |
| 5,066,005 | A | 11/1991 | Luecke | |
| 5,279,530 | A | 1/1994 | Hess | |
| 5,348,374 | A * | 9/1994 | Kuo | 297/344.18 |
| 5,460,596 | A | 10/1995 | Brady | |
| 5,470,298 | A * | 11/1995 | Curtis | 482/130 |
| 5,499,958 | A | 3/1996 | Hess | |
| 5,713,821 | A | 2/1998 | Nissen | |
| 6,042,523 | A | 3/2000 | Graham | |
| 6,077,203 | A | 6/2000 | Lay | |
| 6,206,812 | B1 | 3/2001 | Nizamuddin | |
| 6,244,992 | B1 | 6/2001 | James | |
| 6,758,825 | B1 | 7/2004 | Mathew | |

(Continued)

OTHER PUBLICATIONS

Stein, "15 minutes to a fitter air passenger", Los Angeles Times, Jul. 5, 2004.

(Continued)

*Primary Examiner*—Steve R Crow
(74) *Attorney, Agent, or Firm*—Yee & Associates, P.C.; John A. Lepore

(57) ABSTRACT

Exercise apparatus including first and second foot pads coupled to a frame. The frame includes first and second telescoping members to enable the apparatus to be moved between a stored position and an exercise position. The apparatus may be conveniently stowed beneath a seat of a transport vehicle, and may be secured to the seat tracks aboard the vehicle. Foot pad supports provide resistance to movement of the foots pads, enabling a user to exercise his or her legs while seated to reduce fatigue, increase blood flow and decrease the formation of blood clots.

16 Claims, 5 Drawing Sheets

U.S. PATENT DOCUMENTS

| | | | | |
|---|---|---|---|---|
| 6,808,476 | B2 | 10/2004 | Zagone | |
| 6,979,284 | B2 * | 12/2005 | Curtis | 482/57 |
| 2001/0036885 | A1 | 11/2001 | Castellot, Jr. et al. | |
| 2009/0105046 | A1 * | 4/2009 | Rudich | 482/8 |

OTHER PUBLICATIONS

"5 User tip(s) on eHow to Exercise on a plane", eHow.com, Sep. 14, 2004.

* cited by examiner

EXERCISE APPARATUS FOR TRANSPORT VEHICLES AND RELATED METHODS

CROSS-REFERENCE TO RELATED APPLICATIONS

This application is a continuation-in-part of application Ser. No. 11/006,424, filed on Dec. 7, 2004, now abandoned, the entire contents of which are hereby incorporated by reference.

BACKGROUND

1. Technical Field

The present embodiments relate to exercise equipment and, more particularly, to apparatus for the exercise of leg muscles while seated on a transport vehicle.

2. Description of Related Art

Currently, there are limited options for exercising on an airplane. On very long flights passengers are seated for long periods of time. The ability to stand up and walk around in an airplane is not always practical and the attempt to do so may disturb other passengers.

Some air carriers are considering exercise rooms on board airplanes. However, this requires that the number of seats or cargo space be reduced.

Other exercise options can include exercise-friendly power bands used to provide resistance to the movement of a user's limbs. While others choose to brace themselves against walls, typically near the galley or lavatories, to perform stretching exercises for legs, calves, back, and arms. With increased security concerns on airplanes, the congregation of passengers near the galley or lavatories is discouraged and often prohibited.

Accordingly, there is a need for an exercise option that overcomes the problems discussed above. Embodiments of the disclosure are intended to satisfy this need.

SUMMARY

The preferred embodiments of the present exercise apparatus for transport vehicles and related methods have several features, no single one of which is solely responsible for their desirable attributes. Without limiting the scope of the present embodiments, some of their features will now be discussed briefly. After considering this discussion, and particularly after reading the section entitled "Detailed Description of the Preferred Embodiments," one will understand how the features of the present embodiments provide advantages, which include the capability to provide exercise to leg muscles and increase blood flow in legs, which may prevent the formation of blood clots and/or deep vein thrombosis.

One embodiment of the present exercise apparatus and related methods comprises apparatus for exercising legs while seated aboard a transport vehicle. The apparatus comprises a frame including first and second telescoping members and apparatus for securing the frame to seat tracks in the transport vehicle. A first foot pad support and a second foot pad support are secured to the frame. A first foot pad is secured to the first foot pad support and a second foot pad is secured to the second foot pad support. The foot pad supports provide resistance to movement of the foot pads in a first direction to enable a user to exercise by applying pressure to the foot pads. The first and second telescoping members are configured to enable the first and second foot pads to translate between a stored position and an exercise position.

Another embodiment of the present exercise apparatus and related methods comprises a method of exercising while seated aboard a transport vehicle. The method comprises the step of extending an exercise apparatus from a stored position at least partially beneath a first seat of the transport vehicle to an exercise position. The exercise apparatus includes a frame having first and second telescoping members. The method further comprises the steps of sitting in a second seat of the transport vehicle positioned behind the first seat, and applying pressure to a first foot pad and a second foot pad. The first foot pad and the second foot pad are secured to a first foot pad support and a second foot pad support, respectively of the frame. The foot pad supports provide resistance to movement of the foot pads in a first direction.

Additional advantages, objects, and features of the present embodiments will be set forth in part in the detailed description that follows. Those of ordinary, skill in the art will appreciate that both the foregoing general description and the following detailed description merely present example embodiments, and should not be construed as limiting.

BRIEF DESCRIPTION OF THE DRAWINGS

The preferred embodiments of the present exercise apparatus for transport vehicles and related methods will now be discussed in detail with an emphasis on highlighting the advantageous features. The accompanying drawings are included to further the reader's understanding of the embodiments, and together with the description explain the principles and operation of the embodiments. These embodiments depict the novel and non-obvious exercise apparatus shown in the accompanying drawings, which are for illustrative purposes only. These drawings include the following figures, in which like numerals indicate like parts.

DETAILED DESCRIPTION

Figure 1A:
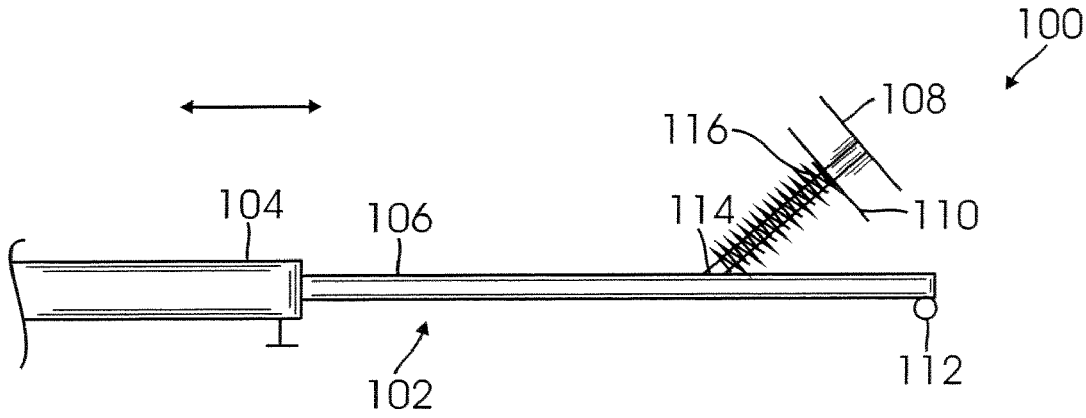
FIG. 1A is a schematic left side elevation view of one embodiment of the present exercise apparatus.
Figure 1B:
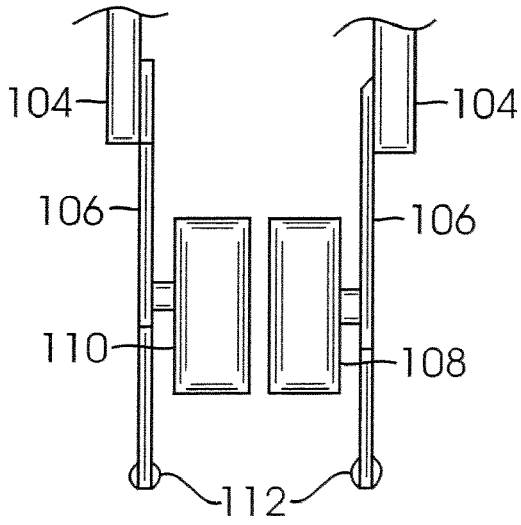
FIG. 1B is a schematic top plan view of the exercise apparatus of FIG. 1A.

The present embodiments allow for exercise of a user's leg muscles while the user is seated. FIGS. 1A and 1B are side and top views of one embodiment of the present exercise apparatus 100. Exercise apparatus 100 includes a glide assembly 102 including two telescoping tracks 104 and 106. The telescoping feature of tracks 104 and 106 allows for track 106 to moveably extend from track 104 in a linear path, generally free of lateral motion.

At the extended end of track 106 is mounted a pair of foot pads 108 and 110. The overall width of foot pads 108 and 110 should provide for travel in a linear path within glide assembly 102, also free of lateral motion. In one embodiment, foot pads 108 and 110 are made slightly narrower then the distance between tracks 104 and 106 of glide assembly 102.

At least one roller wheel 112 is positioned on the extended end of track 106 to evenly distribute the weight and increase the stability of exercise apparatus 100 during use. One skilled in the art will recognize that the number and location of roller wheel 112 is not limited to that which is shown in FIG. 1. Various bracing structures can be used to enhance structural rigidity of tracks 104 and 106 as would be recognized by those of ordinary skill in the art.

Foot pads 108 and 110 permit simultaneous exercise of two legs. Foot pads 108 and 110 may be formed of a variety of materials, such as plastic, metal, or other material that is lightweight, durable and sturdy to minimize flexing when in use. Glide assembly 102 are also formed of plastic, metal or other material that is lightweight, durable and sturdy to avoid flexing when in use. By way of example glide assembly 102 may be formed of aluminum.

In one embodiment, a joint or hinge 114 may be provided to allow the ability to fold foot pads 108 and 110 down toward tracks 104 and 106 for convenient storage. Optionally, a second joint or hinge 116 can be provided near foot pads 108 and 110 to allow foot pads 108 and 110 to be folded along tracks 104 and 106 and lay flat there along.

Foot pads 108 and 110 are sized in width to fit between tracks 104 and 106. Such a width would then easily allow exercise apparatus 100 to fit between the legs of a stationary chair. Exercise apparatus 100 located under a chair allows the path of travel of the user's feet while exercising to be natural. In one embodiment, foot pad travel may be sized in length to provide about a 0.5 inch to about 8 inches of travel, although it is known that shorter lengths may be sufficient for increasing blood flow. Foot pads 108 and 110 may be sized to accommodate any user's feet. Foot pads 108 and 110 are made generally longer and wider than a user's foot to avoid the ends of a user's foot from approaching the ends of the foot pads and be in danger of colliding with surrounding structures. Those of ordinary skill in the art will appreciate that the present exercise apparatus is not limited to any specific dimensions.

In one embodiment, the top surfaces of foot pads 108 and 110 can be texturized to inhibit the user's foot from sliding relative to the texturized foot pads.

In one embodiment, the resistance mechanism is provided by a mechanical spring within a pneumatic cylinder. The mechanical spring is a coil spring providing a minimal amount of resistance for exercise and the pedal return force. The pneumatic cylinder is a cylinder within a cylinder having sliding surfaces that are pneumatically sealed. An internal guide keeps the internal cylinder aligned with the external cylinder. A simple valve connected to the cylinder is opened for less resistance and closed for greater resistance.

In one embodiment, the internal cylinder can be welded or similarly attached to a foot pad, while the external cylinder is welded or similarly attached to an attachment block. The attachment block is welded or similarly attached to the track. The attachment between the external cylinder and the attachment block is made so as to angle the pneumatic cylinder toward the user's foot.

Figure 2:
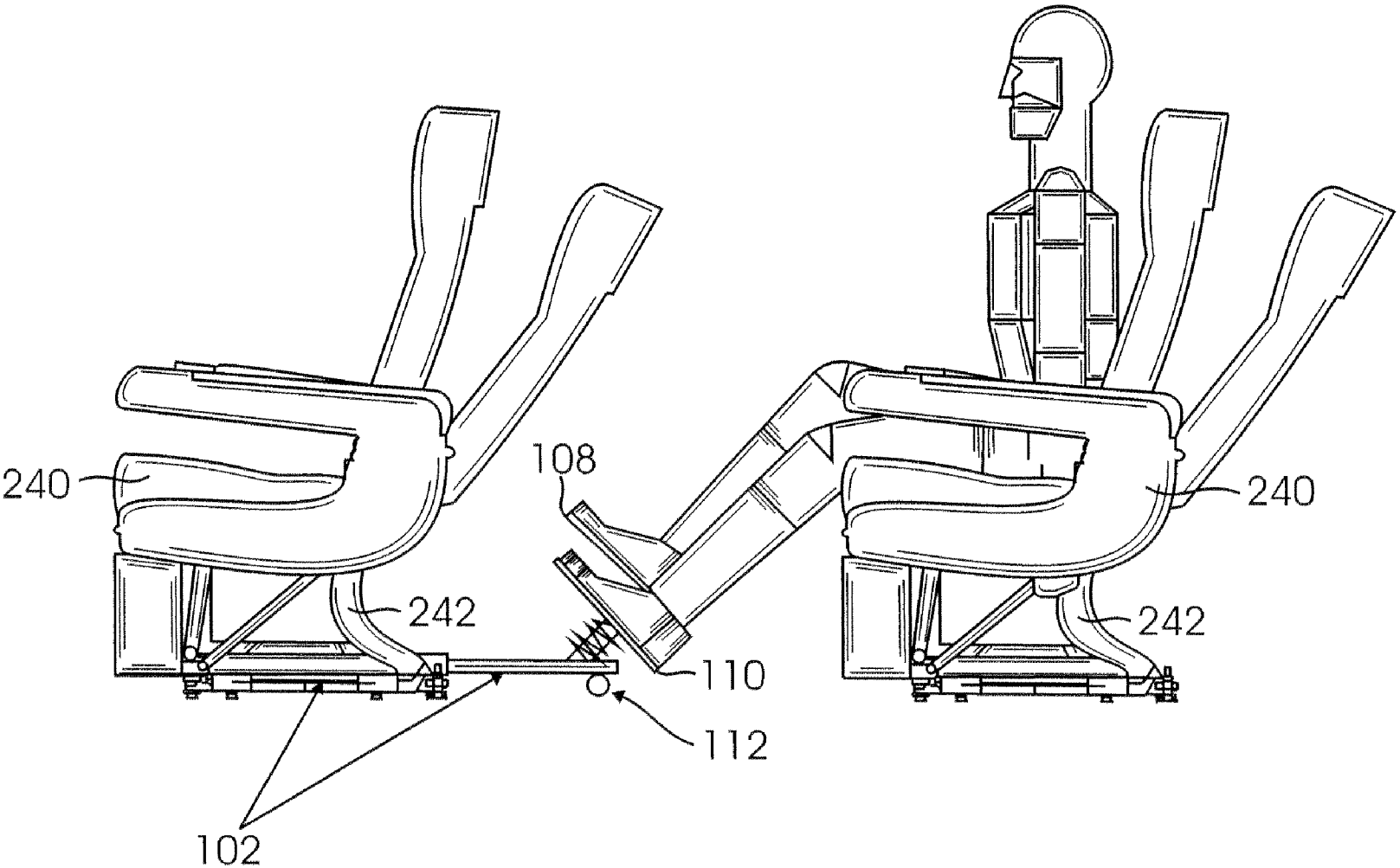
FIG. 2 is a schematic left side elevation view of the exercise apparatus of FIG. 1A mounted beneath a seat on a transport vehicle.

FIG. 2 illustrates exercise apparatus 100 for use as part of a seating configuration in a transport vehicle, such as an airplane seating arrangement. Exercise apparatus 100 is mounted close to the floor and oriented below a seat in front of the user. The user is seated in a chair located at the other end of exercise apparatus 100, such that the chair and the user are facing exercise apparatus 100. The user places one foot on each foot pad 108 and 110. Alternatively or in addition, a user may place her foot on the texturized surface of the foot pads.

In operation, the user moves both feet fore and aft so as to move foot pads 108 and 110 in a translational motion.

Figure 3:
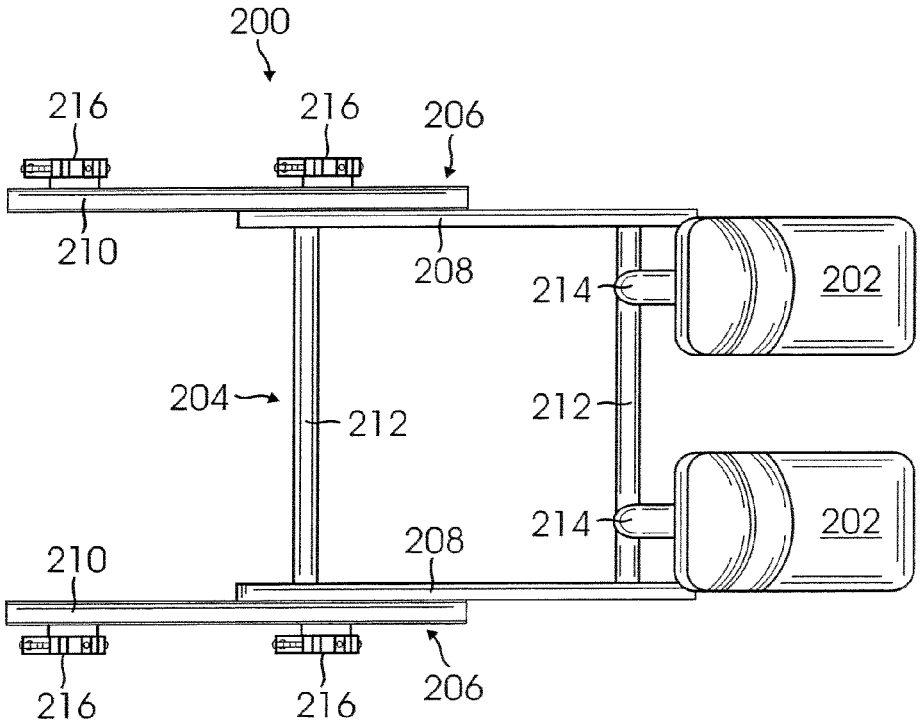
FIG. 3 is a top plan view of another embodiment of the present exercise apparatus.
Figure 4:
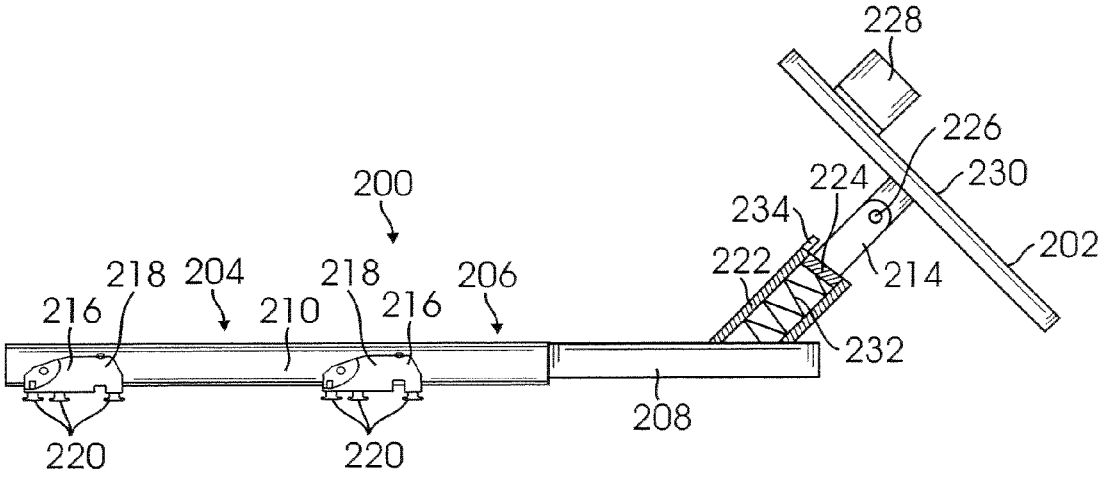
FIG. 4 is a left side elevation view of the exercise apparatus of FIG. 3

FIGS. 3 and 4 illustrate another embodiment of the present exercise apparatus 200. The apparatus 200 includes first and second foot pads 202 configured to receive a user's feet. A frame 204 stabilizes the apparatus 200 and supports the foot pads 202. The frame 204 includes first and second telescoping members 206. Each telescoping member 206 comprises first and second segments 208, 210 configured to translate relative to one another in a telescoping extension/retraction fashion. First and second cross beams 212 extend transversely across the frame 204 and connect the first segments 208 to one another. First and second foot pad supports 214 extend diagonally upward from the first cross beam 212 to support the foot pads 202.

In certain embodiments the frame 204 is substantially rigid. The telescoping members 206, cross beams 212 and foot pad supports 214 may be constructed of materials that are lightweight, stiff and strong, such as metals and/or composites.

Feet 216 extend laterally outward from the second segments 210. In the illustrated embodiment, four feet 216 are shown, but those of ordinary skill in the art will appreciate that fewer or more feet 216 may be provided. The feet 216, which are shown in detail in FIGS. 4 and 6, comprise a body portion 218 and a plurality of tabs 220 that extend downward from the body portion 218. The body portions 218 may be secured to the second segments 210, or may be formed integrally therewith. The tabs 220 are configured to engage slots in track portions aboard a transport vehicle, such as an airplane, as explained in detail below.

With reference to FIG. 4, each foot pad support 214 comprises a pneumatic cylinder 222 that receives a piston 224 to which the foot pad 202 is attached. The attachment between the foot pad 202 and the piston 224 may include a hinge 226, so that the foot pads 202 are able to pivot relative to the pistons 224. By pivoting the foot pads 202 a user may orient the foot pads 202 at a desired angle for increased comfort. Each foot pad 202 may also include a strap 228 configured to extend over the user's foot. The straps 228 assist the user in maintaining his or her feet 216 upon the foot-receiving surfaces 230 of the foot pads 202. The foot-receiving surfaces 230 may include a roughened texture and/or a high friction material to further assist the user in maintaining his or her feet 216 upon the pads 202.

The pneumatic cylinder 222 provides resistance to movement of the foot pad 202 toward the frame 204. The foot pads 202 are thus configured to enable a user to exercise his or her legs by placing his or her feet upon the pads 202 and pressing diagonally downward. A spring 232 within each pneumatic cylinder 222 provides a small amount of additional resistance, and also returns the foot pads 202 to their at rest positions when the user relaxes his or her legs. A valve 234 of each pneumatic cylinder 222 may be opened or closed to adjust a resistance provided by the cylinders 222. Alternatively, the valve 234 may enable a user to increase or decrease an amount of air inside the cylinders 222 to thereby adjust the resistance provided by the cylinders 222.

Figure 7:
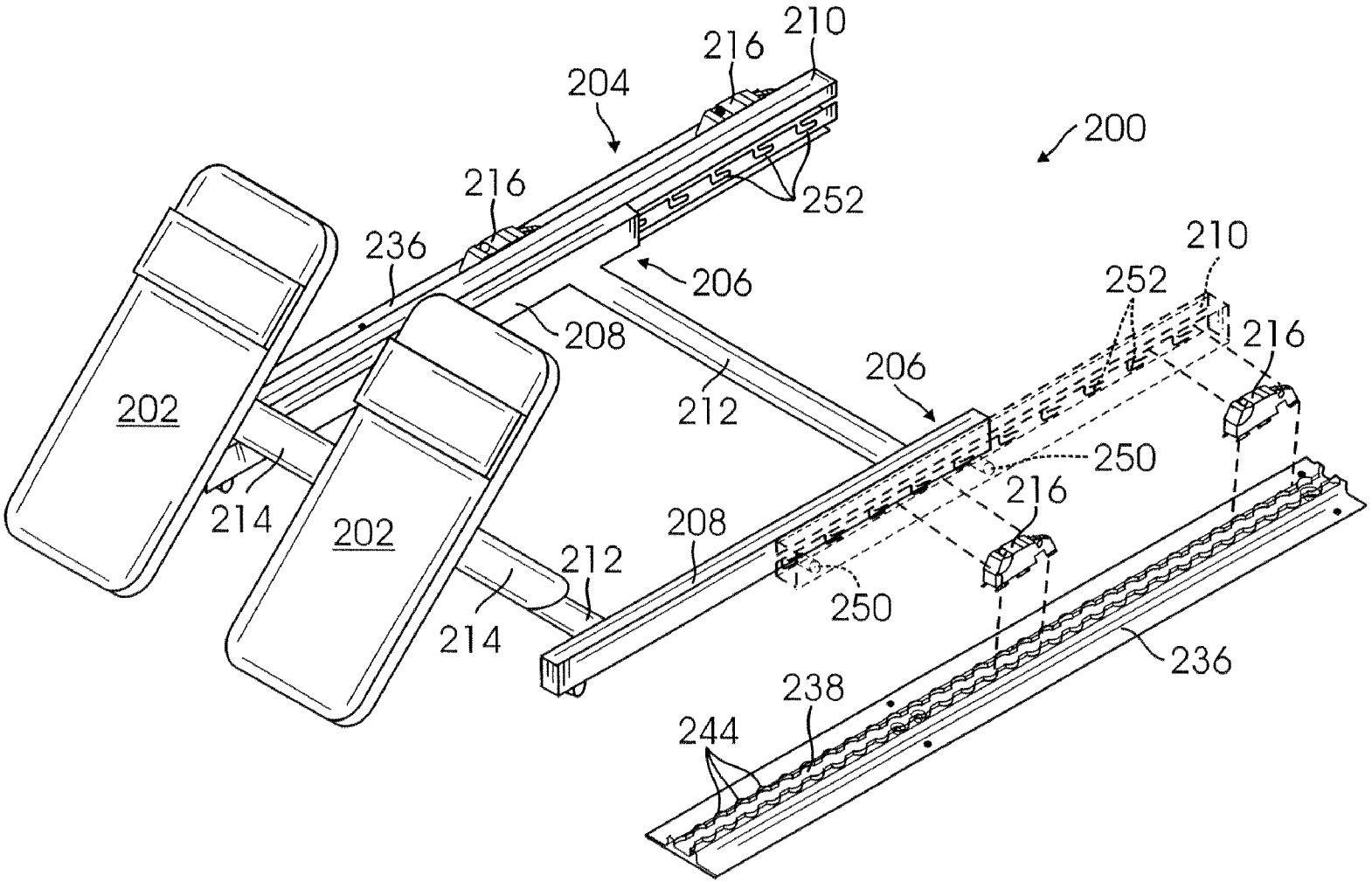
FIG. 7 is a front perspective view of the exercise apparatus of FIG. 3 and a track for securing the apparatus beneath a seat of a transport vehicle.

With reference to FIG. 7, the present exercise apparatus 200 is configured to engage track portions 236 of a transport vehicle (not shown). In a typical transport vehicle, such as a commercial airplane, passenger seats 240 (FIG. 2) are secured within seat tracks 236 in the floor. Each track 236 is anchored to the floor and includes a segmented slot 238 into which a seat support frame 242 (FIG. 2) is secured. A position of the seat 240 may be adjusted by moving the seat support frame 242 backward and/or forward within the tracks 236 and then securing the frame 242 to prevent spontaneous movement of the seat 240.

Figure 5:
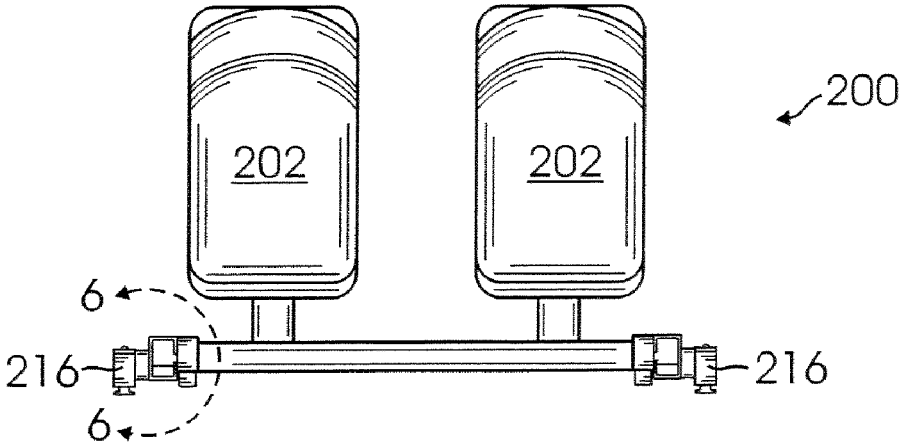
FIG. 5 is a front elevation view of the exercise apparatus of FIG. 3.
Figure 6:
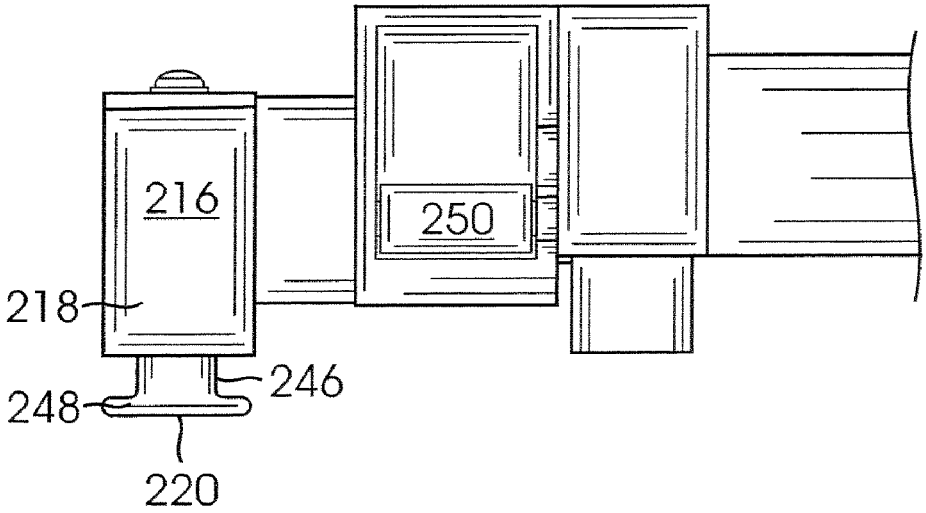
FIG. 6 is a detail view of a portion of the exercise apparatus of FIG. 5 indicated by the line 6-6 of FIG. 5.

As described above, the frame 204 of the present exercise apparatus 200 includes feet 216 having downward extending tabs 220 (FIGS. 4-6). The tabs 220 are configured to engage the tracks 236 to anchor the frame 204 to the floor of the transport vehicle. The tabs 220 may be slidable within the tracks 236 to adjust a position of the frame 204 with respect to the tracks 236. The feet 216 may also be configured to allow the tabs 220 to engage the tracks 236 and prevent the frame 204 from moving relative to the tracks 236. For example, in the illustrated embodiment each foot 216 includes three tabs 220 (FIG. 4). A spacing of the tabs 220 matches a spacing of wide portions 244 of the segmented slots 238 in the tracks 236. The tabs 220 thus may be inserted and/or withdrawn from the tracks 236 by aligning the tabs 220 with the wide portions 244 and moving the feet 216 vertically with respect to the tracks 236. And when the tabs 220 are aligned with the wide portions 244, the feet 216 may be moved laterally inwardly toward one another (in a direction parallel to the cross supports 212), and secured so that narrow stem portions 246 (FIG. 6) of the tabs 220 engage edges of the wide portions 244. Engagement of the stem portions 246 and the wide portions 244 prevents the tabs 220 from sliding within the tracks 236, and engagement of a flange portion 248 of each tab 220 with an underside of each track 236 prevents the tabs 220 from being lifted out of the tracks 236.

The frame 204 is further configured to telescope so that the foot pads 202 can be slid toward and away from a user. As described above, the first and second segments 208, 210 of the telescoping members 206 may translate with respect to one another. Thus, with the second segments 210 held firmly within the tracks 236 by the feet 216, a user may pull the first segments 208 or the foot pads 202 to extend the foot pads 202 from the frame 204, and the user may push the first segments 208 or the foot pads 202 to retract the foot pads 202 toward the frame 204. In the illustrated embodiment, the first segments 208 include tabs 250 (FIGS. 6 and 7) that selectively engage a plurality of slots 252 in the second segments 210. When the foot pads 202 reach a desired position of extension/retraction, the user engages the tabs 250 with the slots 252 to prevent further telescoping movement of the first and second segments 208, 210. To again extend or retract the foot pads 202, the user disengages the tabs 250 from the slots 252 and pushes or pulls the foot pads 202 or the first segments 208 to induce telescoping movement of the first and second segments 208, 210. When the foot pads 202 reach the desired position, the user again engages the tabs 250 with the slots 252. The telescoping movement of the first and second segments 208, 210 enables the present exercise apparatus 200 to be moved back and forth between a stowed position and an exercise position. When in the stowed position, the apparatus 200 can be conveniently concealed beneath the seat 240 (FIG. 2) in front of the user, so that it does not present an obstacle to the user. While in the illustrated embodiment the first and second segments 208, 210 of each telescoping member are arranged side-by-side, Those of ordinary skill in the art will appreciate that the segments could engage one another in an overlapping fashion (one segment slidable within the other segment).

Advantageously, loads applied by the user to the foot pads 202 are transmitted through the foot pad supports 214 to the frame 204 and absorbed in the seat tracks 236. Movement of the foot pads 202 thus does not disturb any other passengers aboard the transport vehicle. The present embodiments also advantageously enable passengers to exercise while seated so as to further reduce any annoyance to other passengers. Allowing passengers to exercise may increase blood flow in the legs.

To exercise his or her leg muscles using the present apparatus 200, the user extends the frame 204 from the stowed position beneath the seat 240 in front of him or her. As the frame 204 extends, the first and second segments 208, 210 of each telescoping member slide relative to one another. When the foot pads 202 reach the desired exercise position, the user engages the tabs 250 on the first segments 208 with the slots 252 on the second segments 210 to lock the frame 204 at the desired extension. While seated, the user then places his or her feet 216 upon the foot pads 202 and applies pressure. When the user is finished exercising, he or she disengages the tabs 250 on the first segments 208 from the slots 252 on the second segments 210 and collapses the frame 204 into the stowed position beneath the seat 240 in front.

The above description presents the best mode contemplated for carrying out the present exercise apparatus for transport vehicles and related methods, and of the manner and process of making and using it, in such full clear, concise, and exact terms as to enable any person skilled in the art to which it pertains to make and use this exercise apparatus. This exercise apparatus is, however, susceptible to modifications and alternate constructions from that discussed above that are fully equivalent. Consequently, this exercise apparatus is not limited to the particular embodiments disclosed. On the contrary, this exercise apparatus covers all modifications and alternate constructions coming within the spirit and scope of the exercise apparatus as generally expressed by the following claims, which particularly point out and distinctly claim the subject matter of the exercise apparatus and related methods.

What is claimed is:

1. Exercise apparatus for exercising legs while seated aboard a transport vehicle, comprising:

a frame including first and second telescoping members and apparatus adapted to secure the frame to seat tracks securing a first seat in the transport vehicle;

a first foot pad support and a second foot pad support secured to the frame;

a first foot pad secured to the first foot pad support and a second foot pad secured to the second foot pad support;

a first resistance mechanism coupled to the first footpad and a second resistance mechanism coupled to the second footpad to provide independent resistance to movement of the foot pads in a first direction to enable a user to exercise by applying pressure to either a one or both of the foot pads; and the first and second telescoping members are configured to enable the first and second foot pads to translate between a stored position beneath the first seat and an exercise position wherein the user seated in a second seat positioned behind the first seat is enabled to exercise by applying pressure to either or both of the foot pads.

2. The exercise apparatus of claim 1, wherein the apparatus for securing the frame to seat tracks in the transport vehicle comprise feet including downward extending tabs.

3. The exercise apparatus of claim 2, wherein the feet are movable in a direction perpendicular to the telescoping motion of the frame to secure the feet within the tracks.

4. The exercise apparatus of claim 1, wherein forces applied to the first and second foot pads are absorbed in the seat tracks.

5. The exercise apparatus of claim 1, wherein surfaces of the first and second foot pads are configured to prevent the user's feet from slipping off of the foot pads.

6. The exercise apparatus of claim 5, wherein the foot pad surfaces include a roughened texture or a high friction material.

7. The exercise apparatus of claim 1, wherein the first and second foot pads are pivotable with respect to the first and second foot pad supports.

8. The exercise apparatus of claim 1, wherein each telescoping member includes a first segment and a second segment, the first segment includes a tab and the second segment includes a slot, and selective engagement of the tab and slot prevents telescoping movement of the first and second segments.

9. The exercise apparatus of claim 1, wherein each resistance mechanism includes a mechanical spring within a pneumatic cylinder.

10. The exercise apparatus of claim 1, wherein each foot pad includes a strap configured to extend over the user's feet to assist the user in maintaining his or her feet upon the foot pads.

11. A method of exercising while seated aboard a transport vehicle, the method comprising the steps of:

extending an exercise apparatus from a stored position at least partially beneath a first seat of the transport vehicle to an exercise position, the exercise apparatus including a frame having first and second telescoping members and apparatus adapted to secure the frame to seat tracks securing the first seat in the transport vehicle, a first foot pad support and a second foot pad support secured to the frame, a first foot pad secured to the first foot pad support and a second foot pad secured to the second foot pad support, a first resistance mechanism coupled to the first footpad and a second resistance mechanism coupled to the second footpad to provide independent resistance to movement of the foot pads in a first direction to enable a user to exercise by applying pressure to either a one or both of the foot pads, and the first and second telescoping members are configured to enable the first and second foot pads to translate between the stored position beneath the first seat and the exercise position;

sitting in a second seat of the transport vehicle positioned behind the first seat; and applying pressure to the first foot pad and the second foot pad.

12. The method of exercising of claim 11, wherein the exercise apparatus includes first and second telescoping segments that slide relative to one another while the apparatus extends from the stored position to the exercise position.

13. The method of exercising of claim 11, wherein the first and second telescoping segments include mating tabs and slots configured to lock the apparatus in the exercise position.

14. The method of exercising of claim 11, wherein the foot pad supports provide a restoring force in a second direction opposite the first direction to return the foot pads to at rest positions when the pressure applied by the user is relaxed.

15. The method of exercising of claim 11, further comprising the step of engaging the user's feet with the foot pads.

16. The method of exercising of claim 11, further comprising the step of collapsing the apparatus into the stored position at least partially beneath the first seat.

* * * * *